US008910396B1

(12) United States Patent
Burchell et al.

(10) Patent No.: US 8,910,396 B1
(45) Date of Patent: Dec. 16, 2014

(54) CONVEYOR TUNNEL

(75) Inventors: Victor Howard Burchell, Howell, MI (US); James Harper Moffitt, York, PA (US)

(73) Assignee: SEETECH Systems, Inc., York, PA (US)

( * ) Notice: Subject to any disclaimer, the term of this patent is extended or adjusted under 35 U.S.C. 154(b) by 280 days.

(21) Appl. No.: 13/466,223

(22) Filed: May 8, 2012

(51) Int. Cl.
*F26B 5/00* (2006.01)

(52) U.S. Cl.
USPC ..... 34/236; 431/328; 198/836.3

(58) Field of Classification Search
CPC ..... F26B 1/00; F26B 5/00; F26B 7/00; F26B 9/00; F26B 9/06; F26B 13/00; F26B 13/10; F26B 13/108; F26B 13/14; F26B 15/00; F26B 15/04; F26B 15/10; F26B 15/22; F26B 15/21; F26B 21/004; F26B 21/12
USPC ..... 34/210, 218, 236, 240; 431/326, 328
See application file for complete search history.

(56) References Cited

U.S. PATENT DOCUMENTS

| | | | | | |
|---|---|---|---|---|---|
| 3,192,648 | A * | 7/1965 | Seedorf | 34/617 |
| 3,267,585 | A * | 8/1966 | Futer | 34/430 |
| 4,173,079 | A * | 11/1979 | Cruff et al. | 34/217 |
| 4,534,118 | A * | 8/1985 | Cabus et al. | 34/514 |
| 5,657,555 | A * | 8/1997 | Milojevic et al. | 34/271 |
| 6,233,841 | B1 * | 5/2001 | Beach | 34/262 |
| 7,181,864 | B1 * | 2/2007 | Coss | 34/380 |
| 7,432,483 | B2 * | 10/2008 | Wilson | 219/700 |
| 8,186,503 | B1 * | 5/2012 | Burchell et al. | 198/836.3 |

FOREIGN PATENT DOCUMENTS

| | | | | |
|---|---|---|---|---|
| CA | 2280199 | A1 * | 2/2000 | |
| DE | 1812509 | * | 4/1973 | |
| JP | 2000210009 | A * | 8/2000 | A23B 5/04 |
| WO | WO 2005037652 | A1 * | 4/2005 | B65B 53/02 |

* cited by examiner

*Primary Examiner* — Steve M Gravini
(74) *Attorney, Agent, or Firm* — Hooker & Habib, P.C.

(57) ABSTRACT

A conveyor tunnel for providing a process environment for articles being conveyed through the tunnel includes a plenum that discharges process air into the tunnel. The flow of the discharged process air is directed to impinge against a portion of the article being conveyed through the tunnel.

23 Claims, 3 Drawing Sheets

CONVEYOR TUNNEL

FIELD OF THE DISCLOSURE

Figure 1:
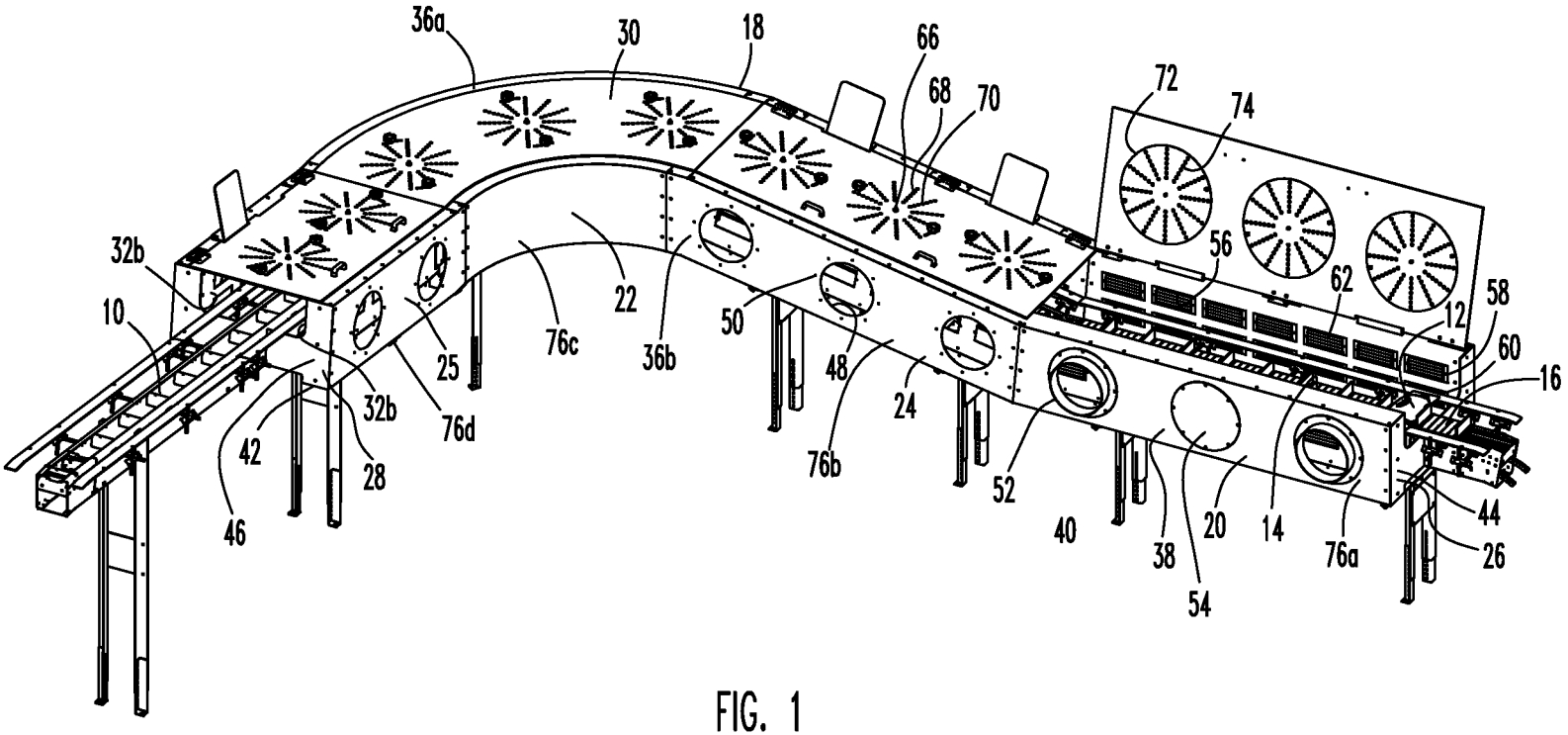
Figure 5:
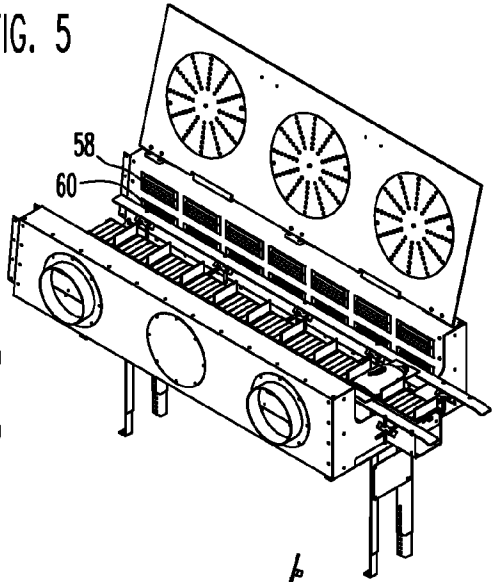

The disclosure relates to a conveyor tunnel or chamber that surrounds and extends along a length of the conveyor, the tunnel providing a process environment different than the ambient environment for articles being conveyed on the conveyor through the tunnel.

BACKGROUND OF THE DISCLOSURE

Conveyors transport material, product, or articles to various processing stations in the course of operation. The conveyor may pass through a tunnel or chamber that provides a process environment that is different from the ambient environment. The articles on the conveyor are exposed to the process environment, which may cool, heat, or otherwise process the articles while on the conveyor.

Some articles have critical portions or elements that need to be heated, cooled, or otherwise processed while moving through the conveyor tunnel. For example, plastic bottle logs ejected from a blow molding machines have weld joints that need to be cooled. The length of the conveyor tunnel is established in part by the need to cool the weld joints. If the tunnel does not efficiently cool the weld joints, the length of the tunnel is longer than otherwise necessary.

Thus there is a need for an improved conveyor tunnel that can more efficiently provide a process environment for heating, cooling, or otherwise processing specific portions of an article being conveyed through the tunnel.

SUMMARY OF THE DISCLOSURE

Disclosed is an improved conveyor tunnel that more efficiently provides a process environment for heating, cooling, or otherwise processing specific portions of an article being conveyed through the tunnel.

An embodiment of a conveyor tunnel includes a plenum that extends along the conveyor path, one side of the plenum facing the conveyor. The interior of the plenum is fluidly connected to a source of pressurized process air. "Process air" can be air for cooling, air for heating, or any other gas or gas mixture (not necessarily including atmospheric air) intended to form the process environment within the cooling tunnel. The plenum includes a discharge opening in the side extending along the conveyor path, with vanes located in the flow of processed air discharged from the discharge opening and directing the flow of discharged process air in a direction generally towards the conveyor path. A second plenum, similar to the first plenum, can optionally be included on the other side of the conveyor path.

In a preferred embodiment, the plenum includes two sets of discharge openings extending along the conveyor path, each discharge opening including an adjustable louver with guide vanes to direct the flow of discharged process air. One set of discharge openings are located above the conveyor's support surface and the other set of discharge openings are located below the support surface.

In another preferred embodiment, the tunnel includes exhaust openings spaced along the conveyor path. The exhaust openings are adjustable to adjust the exhaust area of the opening. The exhaust openings can be set to establish longitudinal flow of the process air in the tunnel prior to the process air being exhausted from the tunnel. The flow direction can be a parallel flow with the direction of conveyor travel, or counter flow in the direction opposite of conveyor travel.

In a further preferred embodiment, the cooling tunnel is formed by joining tunnel segments. The tunnel segments may include straight segments, curved segments, or inclined segments that permit reassembling the tunnel to conform to different conveyor paths.

The disclosed cooling tunnel enables articles to be processed more quickly and efficiently, reducing energy loss and conserving valuable floor space.

Other objects and features will become apparent as the description proceeds, especially when taken in conjunction with the accompanying drawing sheets.

BRIEF DESCRIPTIONS OF THE DRAWINGS

FIG. 1 is a front and top view of a portion of a conveyor extending through a conveyor tunnel assembly, the conveyor transporting a blow molded plastic log or plastic bottle;

FIGS. 2-6 are front, top, right-side, front-right, and front-left views respectively of a portion of the conveyor extending through the upstream or intake tunnel segment that forms part of the conveyor tunnel assembly shown in FIG. 1, the top wall of the tunnel segment in the raised position; and FIGS. 7-10 are front, top, right-side, and front-right views respectively of the upstream tunnel segment shown in FIGS. 2-6 but with the top wall of the tunnel segment in its normal, closed position.

DESCRIPTION OF A PREFERRED EMBODIMENT

FIG. 1 illustrates a portion of an otherwise conventional flexible chain conveyor 10 that extends along a conveyor path. The illustrated conveyor 10 transports blow-molded plastic bottles or bottle logs 12 received from a blow molding machine (not shown) in a downstream direction along the conveyor path to de-flashing and trimming stations (not shown). The conveyor 10 includes a flexible chain 14 that defines an upper conveyor surface 16 that supports the logs 12 on the conveyor.

A portion of the conveyor 10 extends through a cooling tunnel assembly 18. The cooling tunnel 18 includes a straight upstream end path segment 20, a curved path segment 22, a straight, inclined path segment 24, and a straight downstream end path segment 25, the path segments 20, 22, 24, and 25 extending along corresponding adjacent segments of the conveyor path. In other embodiments a curved path segment could also be an inclined segment to conform to the conveyor path, or one or both end segments could be curved and/or inclined segments.

The cooling tunnel assembly 18 extends from a tunnel intake end 26 to a tunnel discharge end 28. The plastic logs 12 enter the cooling tunnel assembly 18 and chilled air impinges on the logs 12 moving through the tunnel assembly 18 as will be described in greater detail below. The logs 12 discharged from the tunnel assembly 18 are sufficiently cooled to enable de-flashing and trimming of the logs 12 at the downstream processing stations.

The tunnel assembly 18 has an upper wall 30, a pair of opposing side walls 32*a*, 32*b*, and a bottom wall 34. The walls 30, 32, 34 cooperate to define a tunnel extending along the conveyor path from the intake end 26 to the discharge end 28.

Each side wall 32*a*, 32*b* faces the conveyor 10 and forms an inner wall of a respective plenum 36*a*, 36*b*. The plenums 36*a*, 36*b* receive and distribute process air (in the illustrated embodiment, chilled air) along the tunnel as will be described in more detail below. The plenums 36*a*, 36*b* are similar to each other and extend along opposite sides of the conveyor path and face opposite sides of the conveyor 10.

Each plenum 36 has an outer side wall 38 spaced from and generally parallel with the wall 32, a top wall 40, and a bottom wall 42, the walls 38, 40 extending between respective upper and lower edges of the side walls 38, 40. The plenum walls 32, 38, 40, 42 define a generally rectangular interior chamber that is closed at its upstream end by a plenum end wall 44 and at its downstream end by a plenum end wall 46.

A number of circular intake openings 48 extend through the outer side wall 38 and are spaced along the conveyor path. Each intake opening 48 is surrounded by a number of circumferentially spaced threaded holes 50 that normally mounts an intake duct 52 for connecting the opening 48 to a source of process air or, if the opening 48 is not to be used, to a cover plate 54 that closes the opening 48.

A number of rectangular discharge openings 56 extend through the inner side wall 32. In the illustrated embodiment the discharge openings 56 are arranged as two sets 58, 60 of openings 56, the openings 56 of each set 58, 60 spaced apart along the conveyor path. The sets of openings 58, 60 are spaced apart from one another in a direction generally perpendicular to the adjacent conveyor path, the openings set 58 spaced above the conveyor surface 16 and the openings set 60 spaced below the conveyor surface 16.

An adjustable louver 62 is mounted in each discharge opening 56. The louver 62 includes a movable set of guide vanes 64 that define flow channels between adjacent pairs of vanes 64. The guide vanes 64 establish the flow direction of processed air discharged from the plenum through the opening 56. The flow direction can be varied through an arc of almost 180° as desired by moving the guide vanes as is known in the louver art.

A number of exhaust assemblies 66 are spaced along the conveyor path. Each exhaust assembly 66 includes an exhaust opening 68 formed as a number of through-holes 70 arranged in radial rows around a central point. Cooperating with the through-holes 70 is a movable exhaust plate 72 that has through-holes 74 arranged in the same manner as the holes 70. Rotating the exhaust plate 72 selectively moves the holes 74 into and out of through-alignment with the through-holes 70 so that the effective area of the exhaust assembly 66 be selectively set anywhere between fully opened and fully closed operating positions to enable process air to escape from the tunnel 18 through the openings 70.

The illustrated tunnel assembly 18 is assembled from a number of tunnel segments 76*a*-76*d* for ease of assembly and to enable a possible set of pre-manufactured segments to be arranged in different ways to accommodate different conveyor paths.

FIGS. 2-10 illustrate the upstream or intake end segment 76*a* that includes the plenum upstream end wall 44.

The walls of the end segment 76*a* are numbered with the same corresponding reference numbers as the walls of the tunnel assembly 18 the walls form part of when assembled. The end segment 76*a* is mounted on a pair of legs 78; segments can be self-standing (that is, with two or more legs 78), may have only one leg 78, or may have no legs (that is, are supported by adjacent tunnel segments).

The illustrated end segment 76*a* has three intake openings 48 in each respective plenum wall 38, three exhaust assemblies 66 aligned with the intake openings 48 in the upper wall 30, and seven louvers 62 in each plenum's respective set of discharge openings 58, 60. Depending on segment geometry, other segments may have more, less, or an equal number of intake openings, exhaust assemblies, and louvers.

One side of the upper wall 30 is attached by hinges 80 to the top wall 40 of the plenum 36*a* and is movable between a closed or normal operating position as shown in FIGS. 7-10 for forming a part of the tunnel 18, and an opened or raised operating position as shown in FIGS. 2-6. As shown in FIG. 1, opening the upper wall 30 provides access to the conveyor 10 and the interior of the tunnel, including the louvers 62.

When in the closed position the other side of the top wall 30 of the segment 76*a* rests against the top wall 40 of the plenum 36*b*. When in the raised position the top wall 30 rests against flat backstops 82 attached to the plenum 36*a*. Shorter tunnel segments or tunnel segments of a different geometry or length may have upper walls fixed in the closed position. For example, the curved segment 76*c* has a fixed upper wall.

Operation of the tunnel assembly 18 is discussed next.

Figure 4:
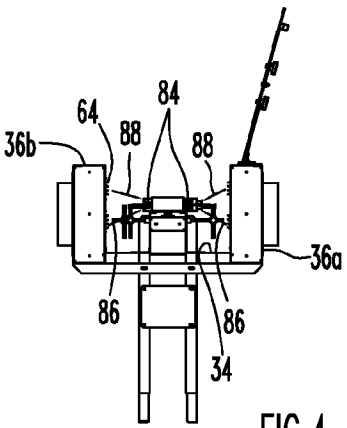
Figure 3:
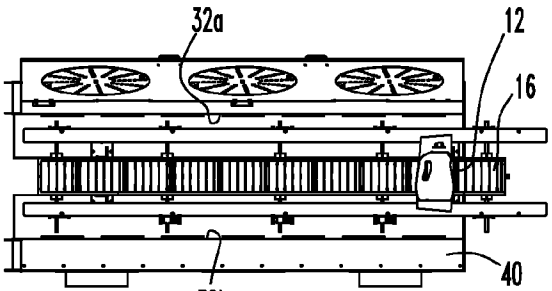
Figure 2:
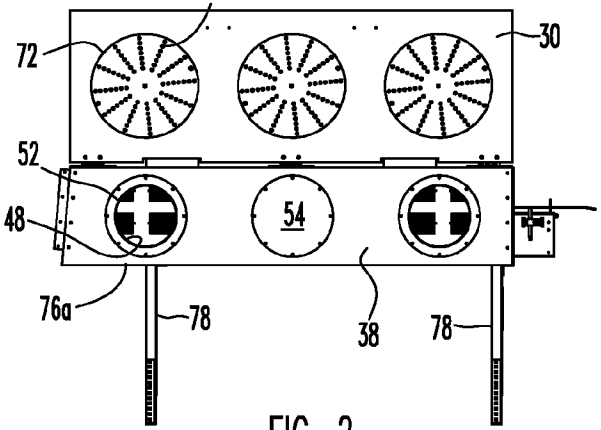
Figure 6:
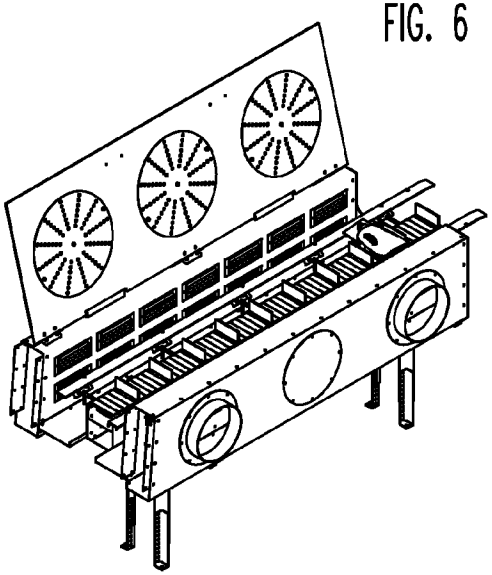
Figure 10:
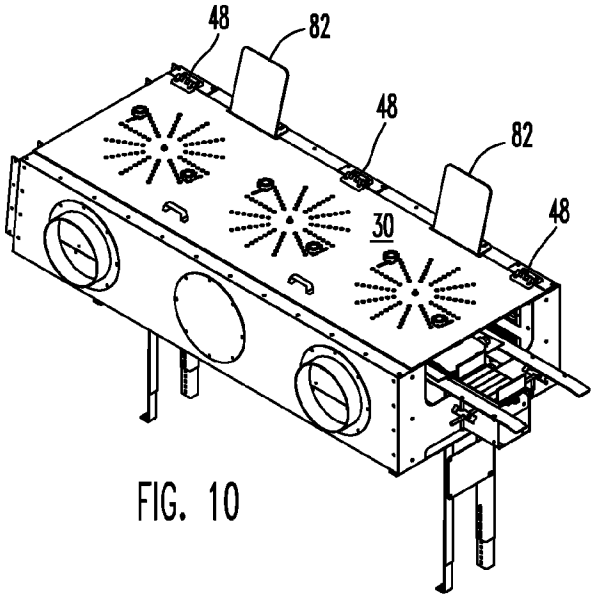
Figure 9:
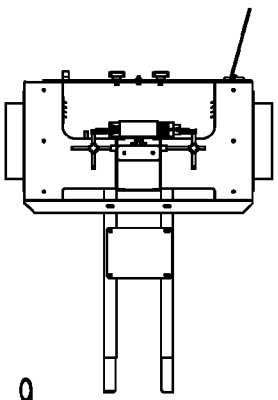
Figure 8:
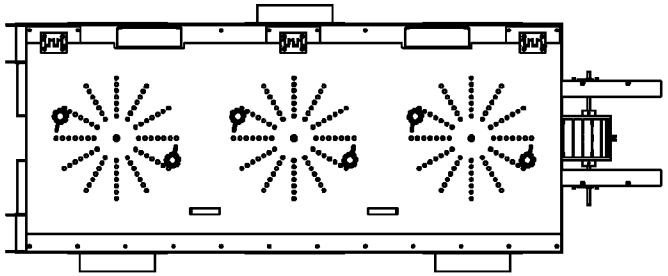
Figure 7:
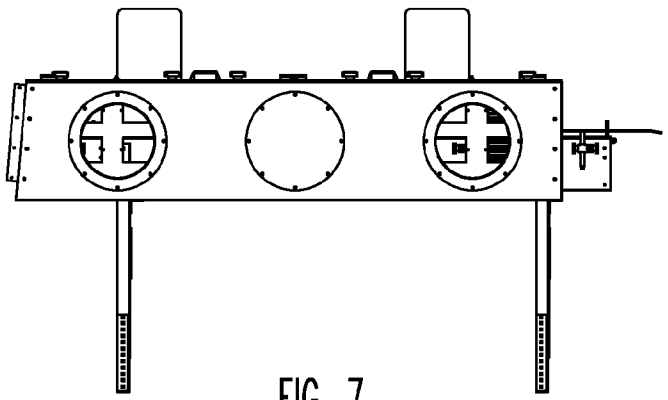

The illustrated tunnel assembly 18 is used to cool the plastic logs 12 ejected from a blow molding machine. Each log 12 has a pair of weld joints 84 located on opposite sides of the log that must be cooled before the log can be de-flashed or trimmed. When the log 12 is on the conveyor surface 16 and moving through the tunnel assembly 18, the weld joints 84 each face a respective plenum 36*a*, 36*b* as best seen in FIGS. 1, 3, and 4.

Prior to operation, the vanes 64 of each louver 62 is placed in its intended operating position to guide chilled air discharged from the plenum through the louver in a direction towards the adjacent weld joint of a log moving past the louver. As best seen in FIG. 4, the upper sets of louvers 62 direct the flow of chilled air downward and the lower sets of louvers 62 direct the flow of chilled air upwards. The two streams 86, 88 of chilled air discharged from the respective plenums 36*a*, 36*b* intersect at and impinge on the adjacent weld joint 84 to maximize heat transfer from the joint to the chilled air and sufficiently cool the log 12.

The upper walls 30 of the wall segments are placed in their closed positions to form the tunnel. The exhaust assemblies 66 are also placed in their intended operating positions to establish the flow of exhaust process air out of the tunnel assembly 18 and to the ambient outside the tunnel. If desired, full or partially opened exhaust assemblies 66 can be separated by one or more closed or less opened exhaust assemblies 66 to establish a flow of process air that must flow in a longitudinal direction along the conveyor path to reach an exhaust. This longitudinal flow of air, which can be a parallel flow or a counter-flow with respect to the conveyor's downstream direction of travel, assists in transferring heat away from the weld joints and out of the tunnel.

During operation, the conveyor 10 moves plastic logs 12 through the tunnel assembly 18. Pressurized chilled air is discharged from the plenums 36*a*, 36*b* through the respective sets of louvers 62 and cools the weld joints 84 as described. When a log 12 reaches the discharge end of the tunnel 18, the log 12 has cooled sufficiently to enable de-flashing and trimming at those downstream processing stations.

While this disclosure has illustrated and described one or more embodiments, it is understood that this is capable of modification, and that the disclosure is not limited to the precise details set forth, but includes such changes and alterations as fall within the purview of the following claims.

What is claimed as the invention is:

1. A tunnel system for impinging process air against articles moving through the tunnel, said tunnel system comprising:

a conveyor extending along a conveyor path;

a pair of first and second plenums on opposite sides of the conveyor path and extending along at least a portion of the conveyor path;

opposed top and bottom walls extending between the first and second plenums, the top and bottom walls and the first and second plenums defining a tunnel surrounding and extending along said at least a portion of the conveyor path;

each plenum defining an interior to receive process air and comprising a first wall facing the conveyor path, a set of intake openings in fluid communication with the interior, a first set of discharge openings in the first wall in fluid communication with the interior of the plenum, and a first set of louvers attached to the plenum, the first set of discharge openings spaced apart along the conveyor path, each louver associated with a respective discharge opening and defining the flow direction of process air discharged into the tunnel through the associated discharge opening, the first set of louvers comprising vanes defining the flow channels, the vanes being movable with respect to the louvers wherein the direction of the flow channels can be selectively varied, the vanes being movable to a position wherein the flow channels extend from the first wall away from the first wall; and one of the said top and bottom walls comprising a set of exhaust openings extending through the said one wall and spaced apart along the conveyor path, each exhaust opening in fluid communication with the interior of the tunnel.

2. The tunnel of claim 1 wherein the vanes are movable along an arc of almost 180 degrees.

3. The tunnel of claim 1 wherein the louvers are movable between a first position wherein the flow channels extend along lines intersecting the conveyor and a second position wherein the flow channels extend along lines not intersecting the conveyor.

4. The tunnel of claim 1 including a set of adjustment devices, each adjustment device associated with a respective exhaust opening and movable between fully closed and fully opened positions to selectively vary the flow area of the associated exhaust opening.

5. The tunnel of claim 1 wherein the said one top and bottom wall with the set of exhaust openings is movable between a normal operating position wherein the said one wall forms a portion of said tunnel and an open position enabling access to the conveyor.

6. The tunnel of claim 1 wherein the first walls of the plenums and the top and bottom walls define a rectangular tunnel.

7. The tunnel of claim 1 wherein each plenum has a second wall spaced from the first wall, the intake openings in said second wall.

8. The tunnel of claim 1 wherein the set of plenum intake openings are spaced apart along the conveyor path.

9. The tunnel of claim 1 wherein one or both of the first and second plenums comprises a second set of discharge openings and a second set of louvers, the second set of discharge openings spaced apart along the conveyor path and spaced from the first set of louvers of such plenum in a direction transverse to the conveyor path, each second louver associated with a respective second discharge opening and comprising movable vanes defining the flow direction of process air discharged from the associated second discharge opening.

10. The tunnel of claim 9 wherein the vanes of the first and second sets of louvers are positionable to define intersecting flow directions.

11. The tunnel of claim 10 wherein the conveyor has a conveying surface defining a plane and the intersection of said intersecting flow directions is spaced away from said plane.

12. The tunnel of claim 1 wherein said tunnel extends along either or both of a curved conveyor portion or an inclined conveyor portion.

13. The tunnel of claim 1 wherein each intake opening of one or both plenums is located at essentially the same location along the conveyor path as a respective discharge opening of said top or bottom wall.

14. The tunnel of claim 1 wherein for at least one of said first and second plenums, adjacent pairs of louvers are more closely spaced than adjacent pairs of intake openings.

15. The tunnel of claim 1 wherein the tunnel is formed from a plurality of tunnel segments that are connected in series along the at least a portion of the conveyor path.

16. The tunnel of claim 15 wherein the tunnel segments comprise straight tunnel segments and curved tunnel segments.

17. A conveyor tunnel for exposing process air to articles moving through the tunnel, the conveyor tunnel comprising:

a tunnel that is placed around and along at least a portion of a conveyor extending along a conveyor path;

a plurality of exhaust openings in the tunnel that fluidly communicate the interior of the tunnel with the ambient outside of the tunnel;

the exhaust openings spaced apart along the conveyor path; and each of the exhaust openings being independently adjustable to vary the area of the exhaust opening whereby the areas of the exhaust openings can selectively vary in different operating runs of the conveyor tunnel.

18. The conveyor tunnel of claim 17 wherein the tunnel extends between opposite ends, the plurality of exhaust openings being the sole openings disposed between the ends of the tunnel that fluidly communicate the interior of the tunnel with the ambient.

19. The conveyor tunnel of claim 18 wherein the tunnel includes one or more discharge openings that fluidly communicate the interior of the tunnel with a source of process air.

20. The conveyor tunnel of claim 17 wherein the plurality of exhaust openings comprises at least three exhaust openings.

21. The conveyor tunnel of claim 17 wherein the conveyor tunnel further comprises a plurality of adjustment plates, each adjustment plate disposed over a respective exhaust opening and comprising an opening movable into and out of through-alignment with the respective exhaust opening.

22. The conveyor tunnel of claim 21 wherein each exhaust opening comprises a plurality of through-openings and each adjustment plate comprises a plurality of through-openings movable into and out of through-alignment with the through-openings of the respective exhaust opening.

23. The conveyor tunnel of claim 17 wherein the plurality of exhaust openings are disposed in a wall, the wall being movable between a normal operating position wherein the wall forms a portion of the tunnel and an open position enabling access to the conveyor.

* * * * *